United States Patent [19]

Dietiker et al.

[11] 3,973,576

[45] Aug. 10, 1976

[54] GAS VALVE WITH PILOT SAFETY APPARATUS

[75] Inventors: Paul Dietiker; Norman F. Green, both of Los Angeles, Calif.

[73] Assignee: Honeywell Inc., Minneapolis, Minn.

[22] Filed: Feb. 13, 1975

[21] Appl. No.: 549,593

[52] U.S. Cl. ..... 137/66; 431/52

[51] Int. Cl.[2] ..... F23N 5/10

[58] Field of Search ..... 137/65, 66; 431/52, 431/53, 54, 80; 251/69

[56] References Cited

UNITED STATES PATENTS

| | | | |
|---|---|---|---|
| 2,258,811 | 10/1941 | Ray | 137/66 X |
| 2,988,098 | 6/1961 | Thomas | 137/66 |
| 3,877,475 | 4/1975 | Dietiker | 137/66 |

FOREIGN PATENTS OR APPLICATIONS

| | | | |
|---|---|---|---|
| 1,924,080 | 3/1970 | Germany | 137/66 |

*Primary Examiner*—Martin P. Schwadron
*Assistant Examiner*—Richard Gerard
*Attorney, Agent, or Firm*—Clyde C. Blinn; Henry L. Hanson

[57] ABSTRACT

A gas valve has a single operating knob for providing the operation of a pilot valve and the resetting operation of a thermocouple controlled safety apparatus with a "supersafe" operation. Specifically, the gas valve has a main operating shaft adapted for both axial and rotary movement by a control knob. A tilting latch is attached to the shaft to provide for operation of a pilot valve and a main safety valve when a thermocouple safety mechanism is energized both for a safety valve resetting operation and to provide a "supersafe" operation.

5 Claims, 6 Drawing Figures

GAS VALVE WITH PILOT SAFETY APPARATUS

BACKGROUND AND SUMMARY OF THE INVENTION

Gas valves for use with gas burners to provide thermocouple controlled safety operation and "supersafe" operation have been known for some time. Such gas valves have a thermocouple energized electromagnet for holding in a safety apparatus when the thermocouple is heated by the presence of a pilot flame; so that, a main safety valve cannot be opened until the pilot flame is proven. Additionally, such valves have "supersafe" apparatus to prevent the main safety valve from being reopened once the valve is closed by turning the main control knob to the off position. When the thermocouple has cooled to allow the electromagnet to be de-energized, the reset of the safety mechanism from an inital starting condition is possible; so that, a safe lighting operation of the pilot must always take place.

Gas valves with various types of thermocouple controlled safety apparatus and "supersafe" apparatus are shown in the following patents and applications: William R. Ray U.S. Pat. No. 3,303,866 which issued Feb. 14, 1967; Hollis L. Randolph U.S. Pat. No. 3,682,188 which issued Aug. 8, 1972; Otto Thomas U.S. Pat. No. 2,988,098 which issued June 13, 1961, Richard K. Fairley et al U.S Pat. No. 3,451,407 which issued June 24, 1969; Nico Van der Linden U.S. Pat. No. 3,572,355 which issued Mar. 23, 1971; Cornelis Kingma U.S. Pat. No. 3,476,130 which issued Nov. 4, 1969; and Paul Dietiker U.S. Pat. No. 3,877,475 which issued Apr. 15, 1975.

The present invention is concerned with a gas valve having a thermocouple controlled safety apparatus and a "supersafe" operation apparatus wherein a single tilting latch member is used on an operating shaft to provide both such operations; thereby, providing a gas valve which is simple and inexpensive to manufacture. The latch member is attached to the single operating shaft so that when the shaft is moved axially, a pilot valve is opened and the thermocouple connrolled safety apparatus is reset. If the resetting operation takes place, upon a partial return of the shaft in the opposite direction the pilot valve will remain open and the main gas valve will be opened. Upon a rotation and release of the main control knob, the pilot valve and main safety valve are turned off. The latch member prevents the resetting of the safety valve, even though the thermocouple controlled safety apparatus is still in the energized position with the thermocouple still being hot. The resetting operation cannot be accomplished to open the main safety valve until the thermocouple cools down thus providing the "supersafe" operation.

DESCRIPTION AND OPERATION OF THE INVENTION

Figure 1:
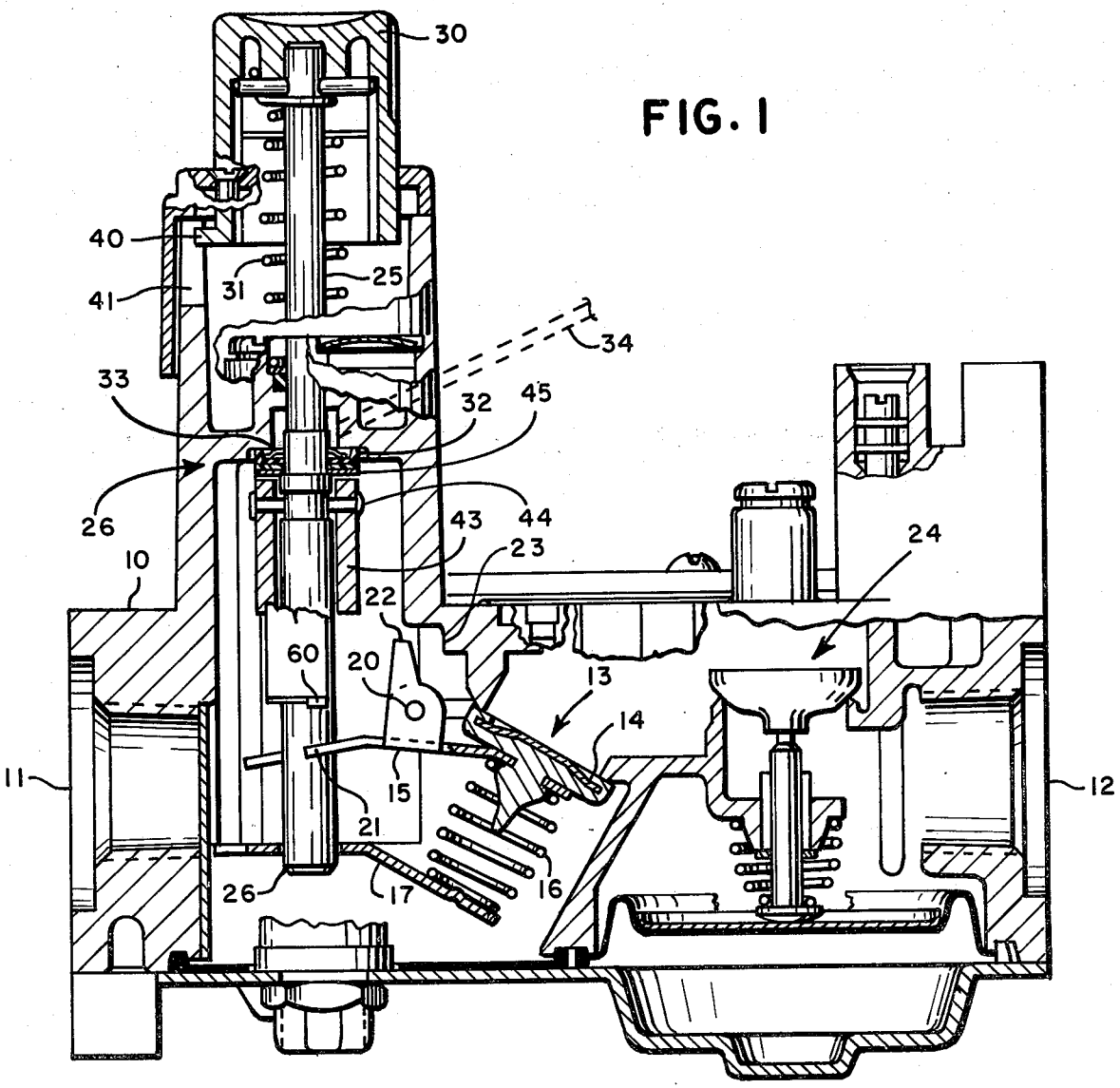
FIG. 1 is a side cutaway view of the gas valve showing the main safety valve, the operating shaft and the tilt latch.

Referring to FIG. 1, a gas valve has a body 10 with an inlet opening 11 adapted to be connected to a source of gas under pressure and an outlet opening 12 adapted to be connected to a gas burning temperature conditioning apparatus or furnace. Mounted between the inlet and outlet in a first gas flow passage is main gas safety valve 13 which has a disc or seating member 14 attached to a pivoted valve support member or lever 15 mounted on the valve body at a pivot 20. Lever 15 is biased to close valve 14 by spring 16 mounted against bracket 17. When safety valve 13 is closed, gas cannot flow from the inlet to the outlet. Arm 15 has a portion or extremity 21 which is engaged for resetting and opening the safety valve and an arm or portion 22 which provides a limit stop when engaging surface 23 of the valve body for arm 15. A second valve 24 connected in series with safety valve 13 controls the flow of gas from the inlet to the outlet after the safety valve is opened in a manner as described in the Paul Dietiker et al U.S. Pat. No. 3,354,901 issued Nov. 28, 1967.

Mounted in the valve body with the body and with bracket 17 as a pilot is an operating reset shaft of member 25. The shaft is attached to an operating knob 30 to provide for downward and axial movement of the shaft against spring 31 to provide a safety resetting operation for main safety valve 13 and to provide for rotary movement of the shaft to turn the safety valve off.

Figure 5:
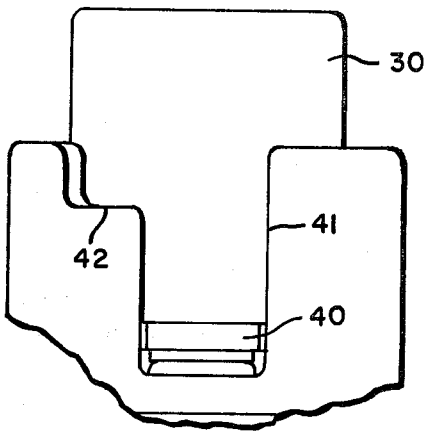
FIG. 5 is an end view showing the control knob of the valve.
Figure 6:
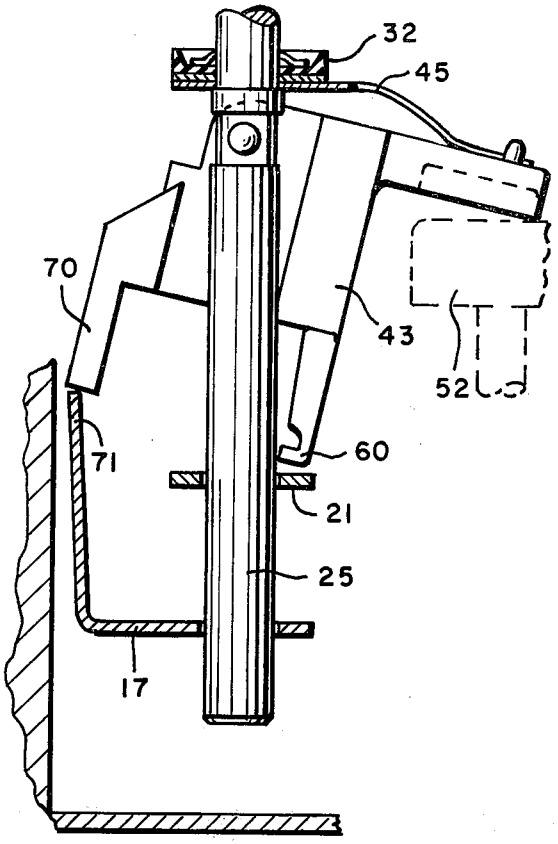
Figure 4:
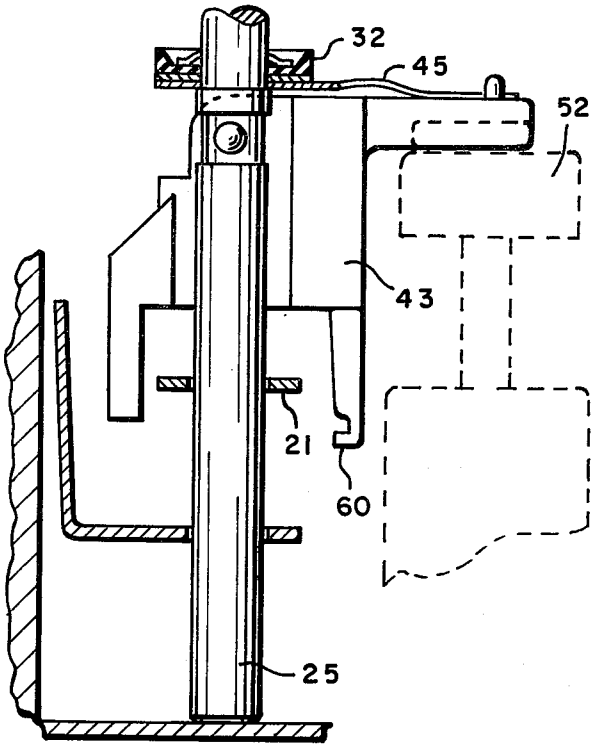

Attached to shaft 25 is a pilot gas valve 26 having a seating member 32 which cooperates with a valve opening or seat 33 connected to a second and independently controlled gas flow passage 34 which is adapted to be connected to a pilot burner. When member 32 is moved away from opening 33, gas flows from the inlet opening 11 to a pilot burner through passage 34 regardless of the operation of valve 14. Pilot valve 26 is closed as shaft 25 is biased by spring 31 in a first position. Knob 30 and shaft 25 are moved downward against spring 31 to a position to open pilot valve 26 and to begin the resetting operation of the safety valve which can only take place when knob 30 is in a position so that a projection 40 as shown in FIG. 5 is aligned with the channel 41 in the valve body. When turned to the off position, projection 40 is on the higher level 42 preventing downward movement of knob 30 and shaft 25 preventing a reset operation from a rotated orientation. Pivotally attached to shaft 25 is a tilting latch or connecting member 43 which is connected with a pin 44 and biased in a clockwise direction by a spring 45 as shown in FIGS. 2, 4 and 6.

Figure 2:
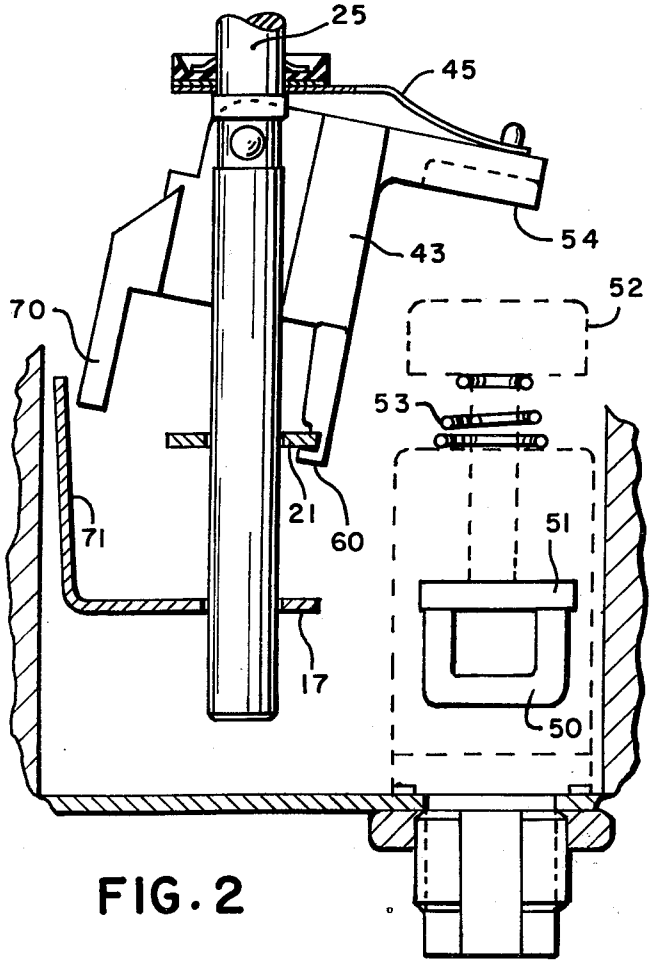
FIGS. 2, 4 and 6 are views of the tilt latch in various stages of its operation in the resetting of the thermocouple safety apparatus.

Referring to FIG. 2, a thermocouple controlled pilot ignition safety apparatus comprises an electromagnet 50 and an armature 51 connected to a member 52. The operation of such a thermocouple safety apparatus is described in the Melvin G. Sogge U.S. Pat. No. 2,746,472 issued May 22, 1956. Upon a downward movement of shaft 25 to move latch member 43 downward, an end 54 of the latch member engages member 52 to move armature 50 against the magnet. At the same time, pilot valve 26 is opened and the pilot burner can be lit.

After member 52 is held iin a downward or restrained position by the energized thermocouple safety apparatus, upon a release of knob 30 to allow shaft 25 to partially move upward under the power of spring 31, latch 43 tilts to the position as shown in FIG. 2. Hook or connecting extremity 60 engages the extremity 21 of safety valve lever 15 to provide an upward force to pivot member 15 clockwise as shown in FIG. 1 to open the safety valve aainst the force of bias spring 16. The partial upward movement of shaft 25 is limited by member 22 engaging the stop 23 so that the pilot valve 26 will allow the pilot gas to continue to flow to the pilot and maintain the thermocouple heated. With safety valve 13 open as long as the thermocouple remains hot to hold in the electromagnet armature 51, gas can flow to the burner under the control of valve 24. Should the pilot flame be extinguished and the thermocouple cool, magnet 50 is de-energized and armature and member 52 move upward under the force of spring 53 to engage the tilt latch 43 and move it to the position as shown in FIG. 4. Arm 15 of the safety valve is released and valve 13 closed under the force of spring 16. In order to reset the safety valve the previously mentioned operation must be repeated.

Figure 3:
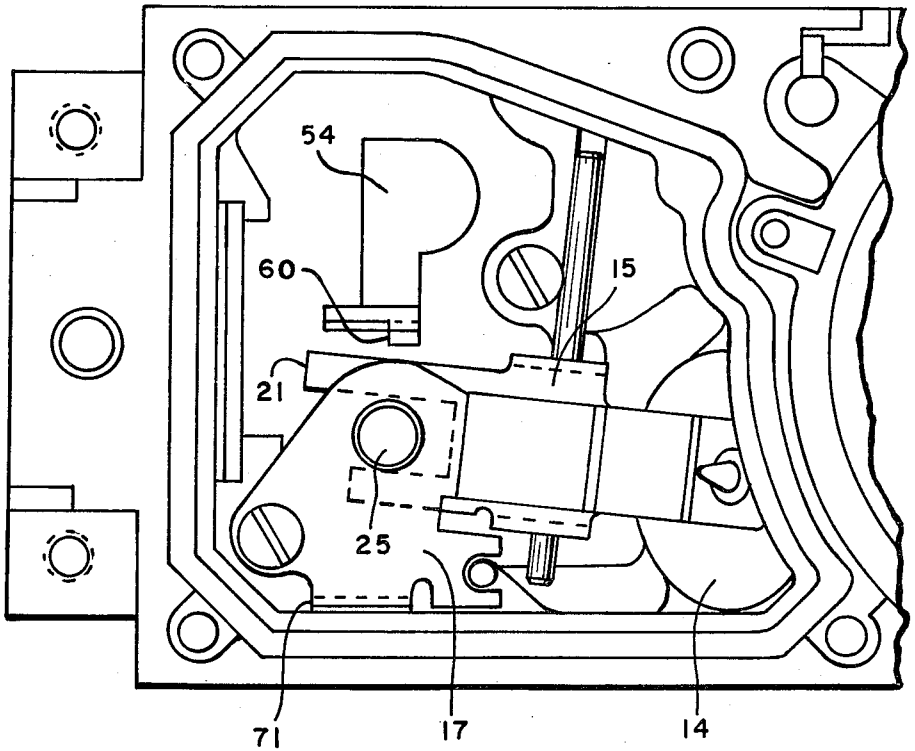
FIG. 3 is a bottom view of the gas valve shown in FIG. 1.

Assuming that the safety reset mechanism has been operated as previously described, that safety valve 13 is held open by latch 43 engaging projection or abutment 21 of arm 15 and that normal operation of the valve is taking place, upon rotating knob 30 to the off position, valve 13 and pilot valve 26 close to turn off gas to the pilot burner and the main burner. Specifically, when shaft 25 is rotated counterclockwise looking at the lower end, shown in FIG. 3, tilting latch 43 moves to a position so that hook 60, as shown in FIG. 2, releases the extremity 21 of arm 15 supporting the safety valve and the valve closes. When hook 60 releases extremity 21, shaft 25 is free to move upward to a first position (shown in FIG. 1) under the force of bias spring 31 to close valve 26.

If a resetting operation of the thermocouple safety apparatus is attempted before the thermocouple cools to deenergize the electromagnet 50, the resetting operation cannot be accomplished. Latch member 43 is biased in a position as shown in FIG. 6, and when knob 30 is depressed against spring 31, projection or portion 70 of latch member 43 engages the abutment or portion 71 preventing a resetting operation. As soon as electromagnet 50 is de-energized, member 52 is biased upward by spring 53 and engages the end 54 of the tilting latch to move it to the position as shown in FIG. 4. The downward motion of knob 30 can then take place to repeat the safety resetting operation previously described.

The embodiments of the invention in which an exclusive property or right is claimed are defined as follows:

1. In a manually reset safety gas valve comprising, a valve body having an inlet opening adapted to be connected to a supply of gas under pressure and an outlet opening adapted to be connected to a gas burner apparatus, main valve means in said body connecting said inlet and said outlet openings, said valve means having a valve support member normally biased in a valve closed position, a manually operated reset member mounted in said body for movement axially from a first position against a spring bias by force applied against an operating knob and for rotation between on and off positions by turning said knob, pilot valve means adapted to be connected to supply gas from said inlet to a burner pilot, said pilot valve means being normally biased to a closed position, means connecting said reset member to said pilot valve means to open said pilot valve means upon movement of said reset member from said first position, ignition safety means comprising a movable member operable in response to a flame to restrain said movable member when said movable member is moved from a first unrestrained position against a spring bias to a second position when a flame is present, a latch member pivotally connected to said reset member and normally biased to a latching position, said latch member having a portion for engaging said movable member of said ignition safety means from said manually operated reset member is moved from said first position to move said movable member to said restrained position, said latch member having a second portion for connecting to said valve support member in a latching position to open said main valve only when said movable member is moved by said reset member and restrained in said second position and said reset member is subsequently released to partially return toward said first position, and means associated with said latch member for releasing said valve support member when said operating knob is turned to an "off" position.

2. The invention of claim 1 comprising;

abutment means on said valve body engaged by another portion of said latch member when in said latching position as said manually operated reset member is moved axially to prevent latching and opening of said valve means when said ignition safety means is operated to hold said movable member in said restrained position.

3. The invention of claim 1 wherein, said valve support member of said main valve means having a stop member for limiting its position when said main valve is opened whereby upon said latch member being connected to said valve support member, said reset member is restrained from movement to said first position and said pilot valve means remains open.

4. The invention of claim 1 wherein said means associated with said latch member is an abutment engaged by said second portion of said latch member when said knob is turned to said "off" position to disconnect said latch member from said valve support member.

5. The invention of claim 4 comprising a channel in said valve body, means connected to said knob to be received by said channel to restrict it axial movement to only when said knob is in said "on" position.

* * * * *

UNITED STATES PATENT OFFICE

CERTIFICATE OF CORRECTION

PATENT NO. : 3,973,576

DATED : August 10, 1976

INVENTOR(S) : PAUL DIETIKER and NORMAN F. GREEN

It is certified that error appears in the above-identified patent and that said Letters Patent are hereby corrected as shown below:

In Claim 1, line 32, delete "from" and insert therefor--when--.

Signed and Sealed this

Twenty-third Day of November 1976

[SEAL]

*Attest:*

RUTH C. MASON
*Attesting Officer*

C. MARSHALL DANN
*Commissioner of Patents and Trademarks*